United States Patent [19]

Mitchell

[11] 4,258,957

[45] Mar. 31, 1981

[54] CUTTING MACHINE NOSE SHOE

[75] Inventor: Ralph W. Mitchell, Franklin, Pa.

[73] Assignee: Joy Manufacturing Company, Pittsburgh, Pa.

[21] Appl. No.: 970,604

[22] Filed: Dec. 18, 1978

[51] Int. Cl.[3] ..... E21C 25/30
[52] U.S. Cl. ..... 299/82; 30/387
[58] Field of Search ..... 299/82–84; 30/387

[56] References Cited

U.S. PATENT DOCUMENTS

| | | | |
|---|---|---|---|
| 1,543,516 | 6/1925 | Pray | 299/82 |
| 2,811,342 | 10/1957 | McCallum | 299/82 |

*Primary Examiner*—Ernest R. Purser
*Attorney, Agent, or Firm*—George Patrick Baier

[57] ABSTRACT

This invention relates to a nose shoe for a mechanically driven cutter chain. The cylindrical nose shoe is capable of being indexed about a central pivot point so as to reposition the outermost surface to compensate for wear. The nose shoe is rotatable in distinct segments, and is locked during operation by means of bolts extending through the cutter assembly in the nose shoe.

4 Claims, 5 Drawing Figures

CUTTING MACHINE NOSE SHOE

One form of mechanized cutter is the type in which an endless chain is driven around a closed path, and cutter bits are attached to the driven chain. Such an assembly provides for a continuous cutting action along a forward or nose section and along one side of the elongated cutter assembly. In mining operations it is typical to use such a cutter chain mechanism in a conventional mine cutting machine. Both the chain and the elongated assembly used to form the chain path are subjected to substantial forces and under normal use are subjected to wear between the moving chain and the fixed chain support assembly. The chain support assembly is often of the type having a longitudinal channel on either side of a cutter bar and a generally semi-circular path at both the front and rear of the bar assembly to form the closed chain path. Cutting operations are normally only performed on one longitudinal side of the cutter bar assembly, generally the side in which the chain is under the greatest tension and the cutter bits are moving toward the driven end of the bar, so as to transport the cut material out of the cut. The highest wear areas on such a cutter bar assembly are those areas adjacent to the side of the chain which is cutting and the nose or forward circular portion. It has been known to provide removable wear surfaces or wear plates along these sections so as to allow the cutter bar assembly to be repaired by fitting new wear plates as they become excessively worn. The cutter nose shoe is that forward portion of the bar assembly which forms the inner generally semi-circular path to guide the chain around the turn and causes the chain to reverse its direction. It has been the practice to make the nose shoe assembly a separate piece which can be replaced due to the wear on this part.

This invention allows for a nose shoe which is indexed around a central pivot point. It has been found that nose shoes tend to wear greatest on the portion of the outer surface which is generally forward and toward the side of the cutter bar that is engaging the material to be mined. By allowing the nose shoe to be composed of a number of symmetrical segments and rotatable about a central axis, as the nose shoe wears the portion with the greatest wear may be indexed away from contact with the chain and a new wear surface indexed under the area of greatest chain contact. In such manner the most desirable chain path can be maintained and chain wear reduced.

I provide for a nose shoe which has a number of wear surfaces which can sequentially be moved into the area of greatest wear without disassembling the cutting bar assembly or removing the shoe itself. An object of the invention is to allow the replacement of a wear surface on the nose shoe of a cutter chain assembly without having to disassemble the cutter chain itself. Another object of the invention is to allow the nose shoe load bearing surfaces to be renewed in the area of greatest chain contact without removing the nose shoe from the cutter assembly. Another object is to provide a nose shoe that removal of excessively worn surfaces from contacting the chain. These and other objects of the invention will be more readily apparent from the following description and drawings in which:

Figure 4A:
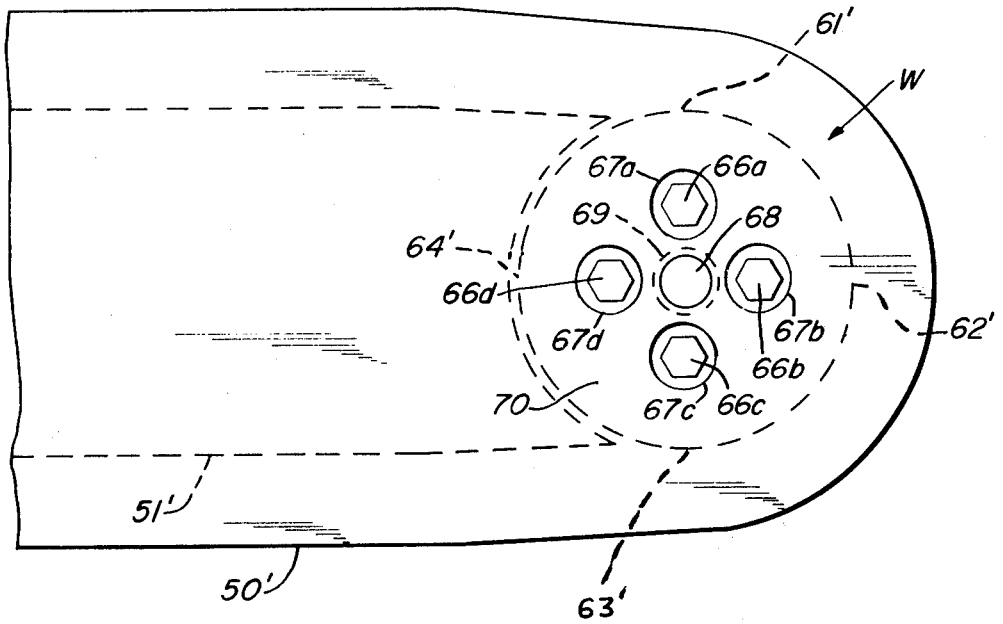

FIG. 4*a* is a plan view of an index type nose shoe on the forward tip section of a cutter bar assembly with the nose shoe shown in dashed line.

Figure 1:
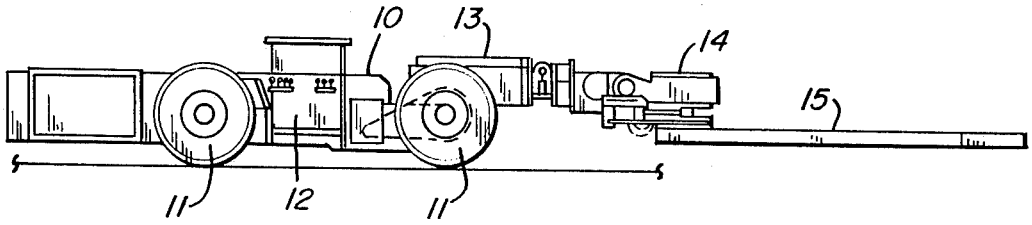
FIG. 1 is a side elevation view of a cutting machine.
Figure 4B:
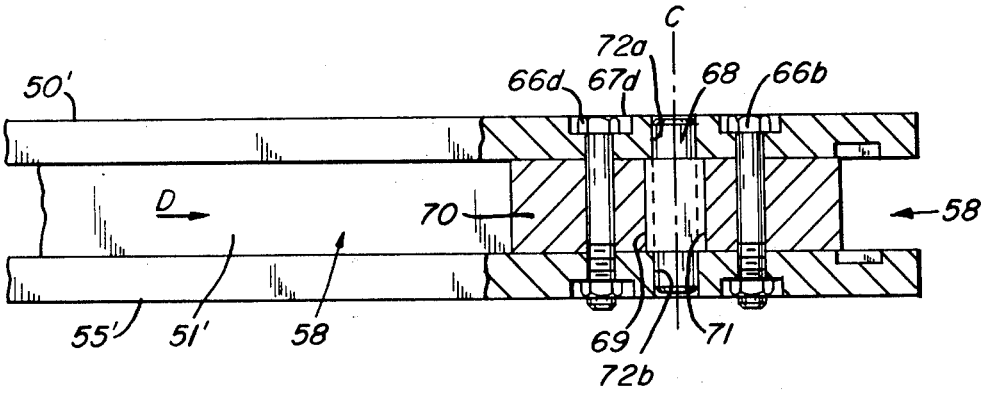

FIG. 4*b* is a right elevational view of the forward tip portion of the cutter bar assembly of FIG. 4*a* shown in partial cross section. Referring to FIG. 1 shows a coal cutting machine having a frame 10 and being propelled by means of wheels 11. The use of a coal cutting machine is well known in the mining art. An operator mounted in the operator's station 12 controls both movement of the car and the cutting operations. A motor 13 mounted on the frame provides drive power to a cutter head 14. The cutter head 14 provides gear reduction and power transmission from the motor 13 to a cutter bar 15.

Figure 2:
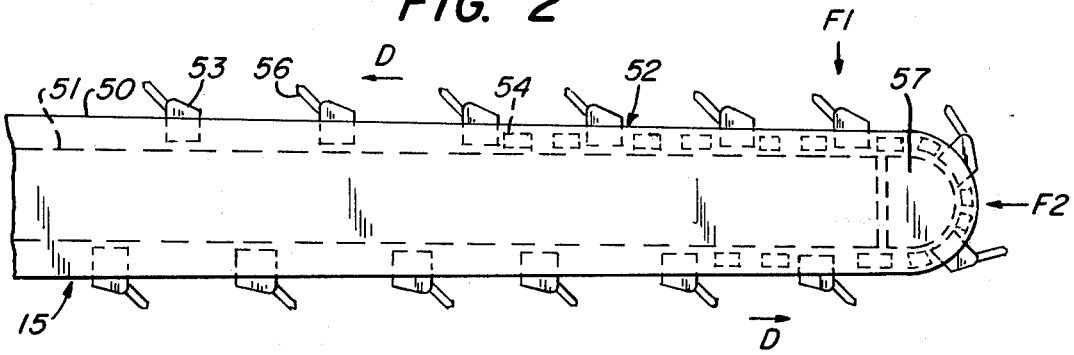
FIG. 2 is a plan view of the forward portion of a cutter bar assembly.

Shown in FIG. 2 is a partial plan view of a conventional cutter bar 15. This cutter bar assembly includes an upper plate 50 a core 51 and a lower plate shown in FIG. 4*b* at 55. These members form a longitudinal channel on either side of the cutter bar 15. In other conventional styles of cutter bars the channel may be formed of one piece. A cutter chain 52 is driven circumferentially generally around this channel by means of a pinion gear or other drive means attached to the cutter head 14 and engaging the chain at the rear of the bar assembly. The cutter chain 52 is composed of link members 54 and link block members 53. The link members 53 hold cutter bits 56 which are used to engage and dislodge bedded materials such as for example coal. The chain is driven in direction D as shown in FIG. 2 by means of the motor 13. During actual cutting operations the greatest wear is exerted on the cutting side of the cutter bar indicated by F1. If for example in cutting coal from right to left, such reference being from the operator's position, the cutter bits 56 shown on the side F1 would be forceably engaging the coal while the cutter bits on the side opposite F1 would be traveling in the space previously cut by the chain assembly. During sumping operations where the cutting assembly 15 is driven directly into a coal face such that the longitudinal axis of the cutter bar is generally perpendicular to the coal face, a large force is exerted on the forward section of the chain assembly as in indicated by F2. Due to the wear caused by the sumping operation on the forward portion of a cutter assembly a replaceable nose shoe 57 is used in this area to create a curved path for the chain to follow as the chain traverses between the channels on opposite sides of the cutter chain assembly.

Figure 3:
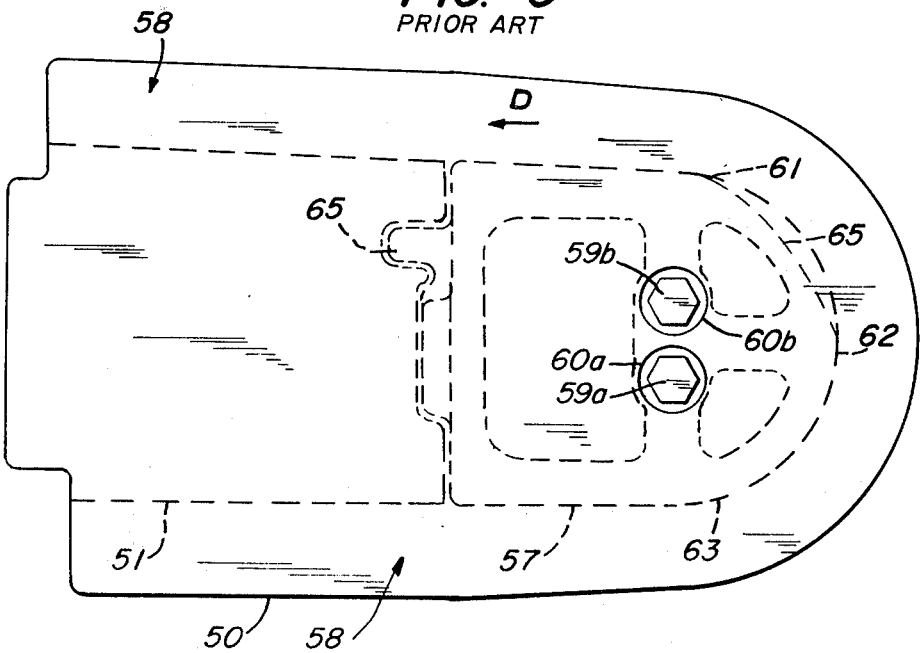
FIG. 3 PRIOR ART
FIG. 3 is a more detailed plan view of the forward tip section of the cutter bar of FIG. 2, with details of the nose shoe shown in dashed line.

FIG. 3 shows a more detailed view of the forward portion of the cutter chain assembly 15. Channel 58 is formed between the core 51 and the upper and lower plates 50 and 55. The nose shoe 57 as shown in FIG. 3 is typical of the replaceable type. Bolts 59*a* and 59*b* which are fitted respectively in recesses 60*a* and 60*b* secure the nose shoe 57 between the upper plate 50 and the lower plate 55. As the cutter chains, not shown in FIG. 3, travels in the channel 58 an area of high wear is created in the area between points 61 and 62 on the nose shoe 57. This wear is undesirable as it creates slack in the chain and causes the chain to move in a path that is undesirable for efficient cutting chain operation. The excessive metal removal in the area between points 61 and 62 create a wear path 65 on the nose shoe 57. While some wear does occur between the points 62 and 63 on the outer forward circumference of the nose shoe 57, such wear is much less than that occurring in the quadrant between points 61 and 62 due to forces F1 and F2.

The nose shoe shown in FIG. 3 has a detent 65 which keys with the forward portion of the core 51 so as to allow the nose shoe 57 to be mounted in only one position on the cutter assembly. In some cutter assemblies no detent is present and the nose shoe 57 may be removed and turned over after excessive wear has occurred such as the path 65. When such a nose shoe not having a detent is reversed, the surface of the nose shoe between points 62 and 63 is positioned in the area of the cutter assembly previously occupied by the wear path 65. Such reversal or flipping of a nose shoe requires the disassembly of the chain and removal of the bolts 59 and the nose shoe 57. p FIG. 4*a* shows a plain view of a presently preferred embodiment in which a generally cylindrical shaped nose shoe 70 is used. The nose shoe 70 is mounted between the upper plate 50' and the lower plate 55' such that except for bolts 66*a*, 66*b*, 66*c*, 66*d*, nose shoe 70 is rotatable about the pin 68. The pin 68 is securely mounted within bores 72*a* and 72*b* shown in FIG. 4*b* in the upper and lower plates 50' and 55' respectively. A bushing 69 is rotatably positioned within the bore 71 shown in FIG. 4*b* in the nose shoe 70.

In operation the nose shoe 70 is installed in a chain assembly as shown in FIG. 4*a* and normal operation of the cutter is performed, with the chain being guided by the outer cylindrical surface of the nose shoe extending from points 61' through 62', to 63'. After a period of normal operation the outer surface of the nose shoe 70 between the points 61' and 62' will wear and it will be desirable to improve the chain path between these two points. At that time bolts 66 are removed and the shoe 70 is indexed 90 degrees counterclockwise, such as for example so that the surface area between 62' and 63' will be in the high wear area generally indicated by the reference W. The bolts 60 are then secured through the upper plate 50', nose shoe 70 and the lower plate 55', such that the nose shoe 70 is securely locked from revolving about the axis C. As is apparent from the above description and drawings a nose shoe constructed as shown in FIG. 4*a* can be indexed four times to provide for wear surfaces at the point of greatest wear W. These four wear surfaces correspond to the outer load bearing surfaces of the nose shoe between points 61' and 62', 62' and 63', 63' and 64', 64' and 61'.

Referring to FIG. 4*b* shows core 51' secured between upper plate 50' and lower plate 55'. Bolts 66*d* and 66*b* extend in bores through the upper plate 50', nose shoe 70, and lower plate 55'. The bolts and their respective securing nuts are mounted in recesses in the plates to achieve a narrow cutting profile as the bar moves through the cut. The pivot pin 68 is fitted in bores 72*a* and 72*b* in the upper and lower plates, 50' and 55' respectively to permit concentric rotation of the nose shoe 70. The pin 68 also extends through the bore 71 in the nose shoe 70. An interposing bushing 69 is also coaxially mounted within bore 71. It is understood that in some embodiments the bushing 68 is omitted and the pin 68 is fitted directly into bore 71, or shoulders are provided on pin 68 to file within bore 71. The channel 58 is shown in FIG. 4*b* at one position on the most forward portion of the bar.

The centerline C of pin 68 coincides with the axis of the nose shoe 70 so that the nose shoe is rotatable about this axis. This axis of rotation C is generally perpendicular to the plane defined by the chain path.

The embodiment shown in FIGS. 4*a* and 4*b* has a nose shoe that is generally cylindrical having an axis C, and arcuate load bearing surfaces extending between 61', 62', 63', and 64'. Other embodiments are not cylindrical and have a plurality of load bearing surfaces along the outer periphery of the shoe each being positionable with respect to the bar member so as to form the guide surface for the chain. The arcuate load bearing surfaces that form the guide surfaces for the chain will be generally at an equal radial distance from the axis of rotation or center of the pivot pin C. At any given indexable position of the nose shoe one or more of these surfaces will not be in contact with the cutter chain. This non-contact position is where unused surfaces are stored until needed, and where worn surfaces are shielded from chain contact.

The present preferred embodiment is shown in FIGS. 4*a* and 4*b* uses a nose shoe 70 which provides a generally circular turning path to guide the cutter chain but it is to be understood that the present invention includes nose shoes whose outermost surface define paths other than circular. The circular nose shoe as shown in FIG. 4*a* allows the indexing of four different areas into the position of highest wear, but the invention includes embodiments where the nose shoe is indexed any number of degrees to reposition the wear area on the nose shoe. If the cutter path created by the nose shoe is other than circular it is understood that the core 51' will be modified on its forward end to allow unobstructed rotation of such noncircular nose shoe. In some applications of the invention where the wear characteristics of the nose shoe are well defined it may be desirable to use a shoe which is indexed in two or three discrete steps, corresponding to 180 or 120 degrees of rotation respectively. The use of four indexable surfaces comprising 90 degrees of the outer cylindrical surface of the nose shoe has been found to be highly desirable as the wear path created in the area of W has been found to occur generally within a 90 degree arc. It is to be understood that while the present preferred embodiment shown in 4*a* uses four bolts 66 and four bores in the upper and lower plate 50' and 55' respectively other arrangements of bolts, or other selective locking means may be used.

A preferred embodiment of the principles of this invention have been described above and shown in the accompanying figures, other variations and embodiments are contemplated and the scope and interpretation of this invention are to be limited only by the following claims.

I claim:

1. A nose shoe apparatus in a cutter bar having upper and lower plate members with spaced parallel adjacent inner surfaces and a cutter chain operably connected to be driven in a closed path between said plates comprising: a cylindrical nose shoe member having a plurality of arcuate load bearing surfaces on the outer cylindrical surface; a first central bore about the axis of said cylindrical shoe member; said plurality of arcuate surfaces lying at an equal radial distance from said axis; said first central bore having an inner load bearing surface permitting concentric rotation of said shoe member about the axis of said bore; said nose shoe member being composed of a solid rigid material capable of supporting radially inward forces exerted by said chain and transmitting such forces through said inner load bearing surface to such plate members said shoe member having at least one second through bore with an axis generally parallel to the axis of said cylindrical shoe member; the diameter of said first central bore being substantially less than the outer diameter of said cylindrical shoe member; said second through bore being spaced radially outward from said inner load bearing surface; the axis of said second through bore being spaced radially inward of said arcuate load bearing surfaces; and at least one of said arcuate load bearing surfaces extending through at least 90 degrees of the outer cylindrical surface of said shoe member.

2. An apparatus in a mechanized cutting machine comprising:

an endless chain with cutter means attached to the outer surface of said chain for dislodging material;

an elongated bar member forming a path for the travel of said chain;

said bar member having upper and lower plate members in spaced relation;

said plate members having generally planar adjacent surfaces in parallel spaced relation forming a slot at one end of said bar member;

a nose shoe member rotatably mounted in said slot formed by said plate members for rotation about an axis generally perpendicular to the plane of said chain path;

said nose shoe member being of generally cylindrical shape with the axis of rotation of said cylindrical shape nose member being generally perpendicular to the plane of said chain path;

said nose shoe member being a solid cylinder composed of a rigid material having a plurality of arcuate load bearing surfaces arranged at generally equal radii from said axis and along the outer periphery of said nose shoe member;

at least one of said load bearing surfaces contacting said chain and forming the inner guide surface of said chain path at one end of said elongated bar member;

at least one of said load bearing surfaces positionable with respect to said bar member so as to be free from contact with said chain;

said nose shoe member having a central axial through bore and at least one through bore generally parallel to and spaced from said axial bore;

said upper and lower plate member each having through bores axial adjacent to and axial aligned with respective said nose shoe through bores;

pivot pin means positioned axial within said central axis bore of said nose shoe member and extending at least partially within the respective bores in said upper and lower plate members for pivoting said nose shoe member about said axis of rotation and for transferring to said upper and lower plate members at least a portion of the radially inwardly directed forces exerted by said chain on said nose shoe member; and at least one bolt means extending through said at least one bore and at least partially extending into respective said adjacent bores in said upper and lower plate members for selectively locking said nose shoe member from rotation about said central axis and for transferring to said upper and lower plate members at least a portion of the radially inwardly directed forces exerted by said chain on said nose shoe member.

3. The apparatus of claim 2 wherein said cylindrical nose shoe has four arcuate surfaces each covering generally 90 degrees of the outer cylindrical surface of said nose shoe.

4. The apparatus of claim 2 wherein said cylindrical nose shoe has three arcuate surfaces each covering generally 120 degrees on the outer cylindrical surface of said nose shoe.

* * * * *

UNITED STATES PATENT AND TRADEMARK OFFICE

CERTIFICATE OF CORRECTION

PATENT NO. : 4,258,957

DATED : March 31, 1981

INVENTOR(S) : Ralph W. Mitchell

It is certified that error appears in the above-identified patent and that said Letters Patent are hereby corrected as shown below:

Column 3, line 16 delete "p".

Column 3, line 62 delete "file" and substitute --fit--.

Signed and Sealed this

*Thirtieth* Day of *June 1981*

[SEAL]

*Attest:*

RENE D. TEGTMEYER

*Attesting Officer*

*Acting Commissioner of Patents and Trademarks*